United States Patent [19]

Maler et al.

[11] 4,106,312

[45] Aug. 15, 1978

[54] METHOD AND APPARATUS FOR SELECTING NEEDLES IN A CIRCULAR KNITTING MACHINE

[75] Inventors: Josef Maléř; Evžen Fischer; Miloslav Losert; Miroslav Kopečný, all of Trebic, Czechoslovakia

[73] Assignee: Elitex, Koncern textilniho strojirenstvi, Liberec, Czechoslovakia

[21] Appl. No.: 768,863

[22] Filed: Feb. 15, 1977

[30] Foreign Application Priority Data

Feb. 20, 1976 [CS] Czechoslovakia ..... 1114/76

[51] Int. Cl.[2] ..... D04B 15/68

[52] U.S. Cl. ..... 66/50 R

[58] Field of Search ..... 66/50 R, 50 B, 42, 14

[56] References Cited

U.S. PATENT DOCUMENTS 2,019,396 10/1935 Deans et al. ..... 66/50 B 2,861,440 11/1958 Crawford ..... 66/42 X

FOREIGN PATENT DOCUMENTS 521,264 5/1940 United Kingdom ..... 66/50 B 1,278,894 6/1972 United Kingdom ..... 66/50 R

*Primary Examiner*—Wm. Carter Reynolds

[57] ABSTRACT

A method and apparatus providing for the selection of certain selector jacks in circular knitting machines, in response to and according to a given recorded program as on a patterning drum or electromagnetic patterning system. These chosen selectors are caused to be racked into engagement with the cam system to be raised, subsequently actuating the appurtenant needles associated with them to form loops in one yarn feed system. Before complete retraction of these needles, those selectors which are not chosen and which do not lift are then racked into engagement with the cam system and caused to raise actuating their needles in the subsequent yarn feed system.

2 Claims, 7 Drawing Figures

S

METHOD AND APPARATUS FOR SELECTING NEEDLES IN A CIRCULAR KNITTING MACHINE

BACKGROUND OF THE INVENTION

The present invention relates to a method and apparatus for selecting needles in a multi-feed circular knitting machine and, in particular, to a method and apparatus for employing a single patterning mechanism for selection of needles in each of two feed systems.

Known circular knitting machines are provided with independent and separate needle selecting devices, for example, patterning drums or electromagnetic selection means, for each yarn feed. In those knitting machines utilizing patterning drums, it is necessary in addition to provide independent pushing devices which control the mechanical needle selectors at each feed, and a control mechanism, such as another drum or calculating chains to properly index each patterning drum in sequence to the movement of the needles and the rotating cylinder. As a result, the apparatus is voluminous and cumbersome, causing a large increase in the overall size of the knitting machine, which in small diameter knitting machines is highly disadvantageous. In addition, the mechanical system requires an increase in parts which is both costly in manufacture and costly to maintain and keep in perfect operation.

Although a similar case is encountered in knitting machines which are provided with an electromagnetic selection system, the complications and complexities in construction are generally encountered in an increase in the electronic portion of the system. In any event, the electromagnetic selection system is costly to produce and costly to maintain and keep under proper repair.

It is an object of the present invention to mitigate the above disadvantages and to provide a multi-feed knitting machine having an improved method and apparatus for needle selection.

It is a further object of the present invention to simplify the construction of a circular knitting machine and, in particular, that portion required for needle selection so that only a little space is required.

It is a further object of the present invention to provide a single needle selection system in a multi-feed knitting machine capable of simultaneously selecting needles for each of two sequentially arranged feed systems.

The foregoing objects, together with other objects and advantages, are set forth in the following disclosure of the present invention.

SUMMARY OF THE INVENTION

According to the present invention the method and apparatus comprises providing for the selection of certain selector jacks, in response to and according to a given recorded program as on a patterning drum, or electromagnetic patterning system. These chosen selectors are caused to be rocked into engagement with the cam system to be raised, subsequently actuating the appurtenant needles associated with them to form loops in one yarn feed system. However, before complete retraction of these needles, those selectors which are not chosen and which do not lift are then rocked into engagement with the cam system and caused to raise actuating their needles in the subsequent yarn feed system.

In one embodiment of this invention, the controlling operation of the needles in a circular knitting machine having two yarn feed systems, a cam system and a needle selection system for each needle including at least a needle jack and a selector jack cooperating with said cam system to reciprocate the associated needle, is obtained by arranging, before the stitch knock-oner-point of one of the feed systems, a pattern selection means for rocking certain ones of said selector jacks into engagement with the cam system. The cam system includes a lifting cam arranged after the clearing point of the one feed system to raise those certain ones of the selector jacks to actuate the associated needle in the other of the feed systems. Further arranged, prior to the stitch knock-over of the other of the feed system there is a tilting cam to rock the selector jacks not moved by the patterning means into engagement with the cam system and after the stitch knock-over-point of the other feed system a lifting cam to raise these other selector jacks to activate the associated needles in said one feed system.

In a second embodiment an intermediate jack is located between the selector jack and the needle jack and those intermediate jacks associated with the non-chosen selector jacks are subsequently rocked to actuate the appurtenant needles.

Full details are set forth in the following disclosure and in the accompanying drawings.

DESCRIPTION OF THE INVENTION

Before turning to the details of the present invention, it is to be noted that the present invention is applied to circular knitting machines of otherwise conventional constructions, having multiple feeds. As indicated, the present invention is directed to the selection of needles in each of two successive feed systems through a single action on the associated needle selector and/or intermediate jacks. Therefore, for brevity's sake, only that portion of a cylindrical knitting machine, its associate cam systems and the apparatus necessary for understanding the present invention are illustrated and will be described herein. Those portions of cylindrical knitting machines of either double or single cylinder construction which are not shown are deemed to be conventional in nature and will be well known to those skilled in the present art.

Figures 1, 1A, 2A, 2B:
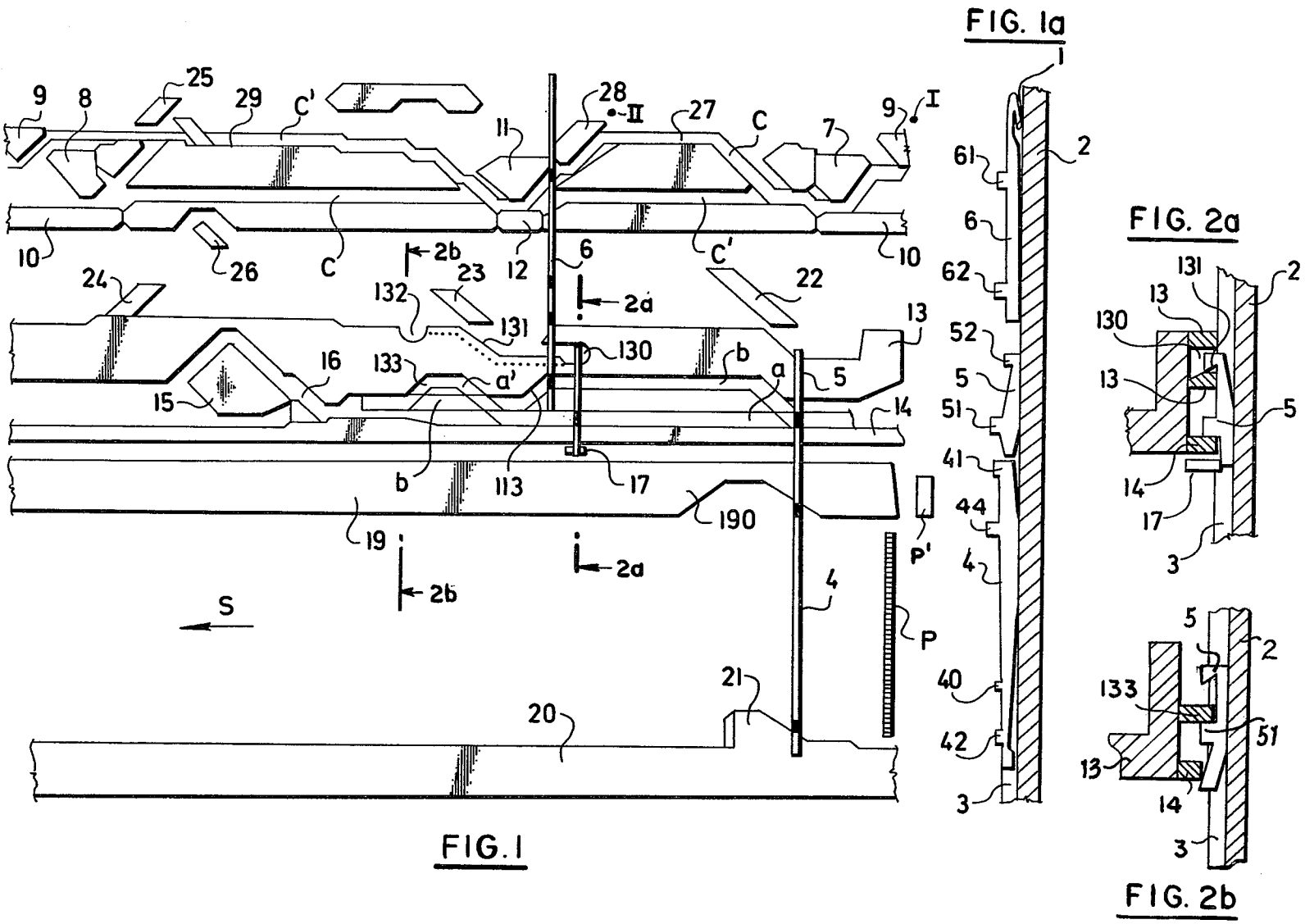
FIG. 1 is a diagram, in planar development, of a cam system for a circular knitting machine showing the course of the various selector jacks, intermediate jacks and needle jacks, employed for needle selection.
FIG. 1*a* is a sectional view through a portion of the lower needle cylinder of a two-cylinder needle machine showing the axial arrangement of the needles, needle jacks, intermediate jacks and selector jacks for selection; the elements as shown in FIG. 1*a* being in line with the cams and cam paths associated with each, respectively, shown in FIG. 1.
FIG. 2*a* is an enlarged cross-sectional view of a portion of the needle cylinder and cam surface as taken along line 2*a* — 2*a* of FIG. 1.
FIG. 2*b* is a view similar to FIG. 2*a* taken along line 2*b* — 2*b* of FIG. 1.

In the embodiment illustrated in FIGS. 1–2, the present invention is employed in a two cylinder knitting machine, of which only a section of the lower cylinder is shown in FIG. 1*a*. The cylinder carries a plurality of needles each needle 1 of which is reciprocably mounted in a groove 3 in which is also mounted, in ascending order, a needle selector jack 4, an intermediate jack 5 and a needle jack 6, the movement of which causes the needle 1 to be raised and lowered.

Arranged about the periphery of the needle cylinder are two yarn feed systems (a main and secondary system I and II, respectively) delivering yarn to the needles during their upward and downward movement whereby loops can be formed. The movement of the needle jacks 6, actuating the needles 1, in the respective yarn system is obtained in accordance with the present invention by a single "selection" of selector jacks 4 which in turn causes a selective engagement of itself and/or of the intermediate jacks 5 and the upper needle jacks 6 with the controlling cam system illustrated in FIG. 1, arranged circularly about the cylinder, the cylinder moving relatively thereto as indicated by the arrow S.

The cam system controlling the operation of the needle jack 6 at the main feed system I includes a left stitch cam 7, a right stitch cam 8, an intermediate or central cam 9, and a tray cam 10 situated below and extending horizontally across the total breadth of the feed system. At the secondary feed system II the cam system includes a stitch cam 11, and a horizontal tray cam 12. Lifting cams 27 and 29 precede the feed systems respectively. The lifting and stitch cams form two paths C and C′ through which the needle 1 can be made to move depending on the nature of the selection. The needle jack 6 is provided with an upper butt 61 adapted to ride in paths C and C′ and a lower butt 62. The cam system for controlling the movement of the needle jack includes radially displaceable cams 22, 23, 24, 25 and 26, which are selectively moved into engagement with the butts 61 and 62 to guide their movement.

The intermediate jack 5 is adapted to rock or pivot within the groove 3 and is, therefore, provided with an angularly formed back edge having an apex intermediate its ends. The intermediate jack 5 is provided with a lower butt 51 and an upper butt 52. These butts are adapted to cooperate with and be controlled by a cam system comprising a pair of outwardly extending box cam rings 13 and 14, a lifting cam 15, a radially displaceable cam 16, and a tilt cam 17.

Figure 5:
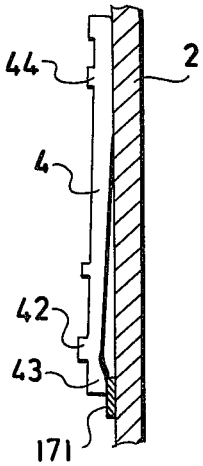
FIG. 5 is a view similar to that of FIG. 4 showing the selector jack at the lower position at the moment of swinging away from the needle groove.

Finally, the selector jacks 4 are also formed to rock within the groove 3 and are provided with an angular back similar to that of FIG. 5. In addition, the selector jacks 4 are provided with a selector butt 40, an upper butt 41, a lower butt 42 and an operational intermediate butt 44. The butts of the selector jack 4 are adapted to cooperate with the portion of the cam system comprising box cam rings 19 and 20.

Briefly, the movement of the needle 1 is obtained on the one hand by "selecting" appropriate ones of selector jacks 4 causing it to move into engagement with the intermediate jack 5 which causes it to rise into engagement with the needle jack 6, causing the butts for the needle jack to ride in the cam system of the secondary feed yarn system II or, on the other hand, by "not selecting" certain ones of the selector jacks 4, and thereby not raising the intermediate jack 5 causing the intermediate jack 5 to ride in its portion of the cam system which does not move the needle jack until the system reaches the primary feed system I. Thus, a single choice of the position of selector jack 4 determines needle movement in yarn feed I and II.

The selection of the selector jacks 4 is obtained by means of the operation of a set of pressbuttons P arranged transversely of the direction of movement of the system at a point in the system ahead of the main feed I. The pressbuttons P are actuated by a patterning drum or electronic pattern system of conventional design, which is not shown. On operation of the patterning drum, for example, one or more of the pressbuttons are pushed forwardly out of the plane of the cam system into engagement with an operating butt 40 to effect a rocking motion of the selector jack pushing the upper end outward from the groove 3. In addition, ahead of the set of pressbuttons P, there is arranged a plunger cam P′, also of conventional design, which is adapted, in this instance, to be selectively actuated to engage the upper operational butt 41, to rock the selector jack 4 back into the groove in an opposite manner to that obtained by the pushbutton.

The system of cams cooperating with the intermediate jack 5 is further constructed so that the box ring 13 is provided with a generally horizontally extending recess 130 which is located just ahead of the clearing point of the secondary yarn feed clearing cam 11. The part of the box ring 13 beginning in the recess 130 is formed at least in part with a sharp edge 131, as seen more clearly in FIG. 2. The sharp edge 131 extends from the point of the recess 130, first in a horizontal direction, secondly in an upwardly inclined direction, terminating in a second recess 132. The nature of the sharp edge of the 131 is shown by the dash line in FIG. 1.

With the foregoing description of the structural elements in mind, operation of the present system to cause selection of the needles in each of the main and secondary feed systems can be further explained. During operation, the needle cylinder 2 is caused to rotate relative to the cam system in the direction indicated by the arrow S. In initial operation, the radially displaceable cams 16, 22, 23, 24, 25 and 26 are retracted, that is, pulled back radially away from the needle cylinder and thus, are not capable of acting upon or cooperating with the needle jacks 6 or the intermediate jacks 5. As the cylinder rotates, the upper butts 41 of the selector jacks 4 engage with the plunger mechanism P′, arranged ahead of the set of pushbuttons P. In this manner, the upper ends of the selector jack 4 is pushed into the groove 3 causing the selector jack 4 to rock, (clockwise, as shown in FIG. 1*a*) moving the bottom butt 42 outwardly into a position where it may be caused to engage with the cam 20. If the selector jack 4 is to be employed in the main feed system, but not in the secondary feed system, the patterning drum, associated with the pressbuttons P, cause an extension of the pressbuttons P into engagement with the operational butt 40 at the lower end of the selector jack 4, thus rocking the lower end of the selector jack 4 back into engagement with the bottom of the groove 3. The selector jack 4 thus returns to what is called an "unselected position". On the other hand, if the selector jack 4 is to move the needle 1 into operation during the secondary feed system, the patterning drum does not function to return or re-rock the selector jack 4 and the selector jack 4, initially pivoted through operation of the plunger bar P′ on the upper butt 41, remains in a selected position.

On further rotation, therefore, the chosen or selected selector jacks 4, with their lower guiding butts 42 extending outwardly of the surface of the cylinder 2, engages a lifting edge 21 formed on the cam ring 20, as a result of which the selector jack 4 is lifted into engagement with the bottom end of the intermediate jack 5. The intermediate jack 5 is at this position normally arranged so its upper end is rocked back into the groove 3 while its lower end and butt 51 extend radially outward therefrom. Upon being lifted by the selector jack 4, the control butt 51 passes from the horizontal cam path a, that is, from a rest movement on the horizontal cam 14, into a path b, and is raised into engagement with lower edge of cam 13. The intermediate jacks 5 thus moved into path b can be termed "the selected jacks". These intermediate jacks 5 are thus caused to move into engagement with the lower end of the needle jacks 6, lifting them and causing the upper butts 61 to move through the path c, being raised by the cam 27. As a result, the appurtenant needles 1 are lifted into the knitting position for knitting in the subsidiary feed II whereupon the upper butts 61 of the needle jacks 6 move into engagement with the stitch cams 28 and 11, at which time yarn is laid onto the needles 1 and the loops are formed.

While the needles associated with the chosen selector jacks 4 are raised and lowered in the second feed system, the associated selector jacks 4 are returned into their original positions by the continuation of the butt 44 along the edges 190 of the box cam ring 19. The needle jacks 6 are retracted upon stitch cam 11, while the associated intermediate jacks 5 are retracted into their non-selected position by continuation in the path b in engagement with edge 113. Once the appurtenant needle jacks 6 are retracted, they are not lifted again and their upper butts 61 pass below the raising cam 29, preceding the primary feed I. Thus, the chosen needles 1 arrive in the main feed in their lower inoperative position and do not form loops at the main feed.

On the other hand, those needles destined for operation in the main knitting feed system are operated in the following manner. The "non-selected" selector jacks 4 which are not caused to engage the edge 21 of the box cam 20 because the lower butt 42 remains retracted within the groove 3 do not engage the appurtenant or associated intermediate jacks 5. These intermediate jacks are not lifted and their control butts 51 remain moving within the horizontal path *a*. The associated needles 1 are thus not lifted and pass through the subsidiary feed in their lower inoperative position, moving directly in the horizontal path *c′*.

As soon as the "non-selected" intermediate jacks 5 pass the radially extending tilting cam 17, they are rocked so that the upper butt 52 is moved radially outward of the groove 3 of the needle cylinder and is pushed into the recess 130 in the box cam 13, as clearly indicated in FIG. 2. Upon continued rotation, the upper butts 52 of the intermediate jacks 5 engage over the sharp edge 131 of the box ring 13, which then causes intermediate jack 5 to be lifted upwardly into engagement with the lower edge of the associated needle jack 6. Lifting of this "non-selected" needle jacks occurs, as will be seen from the cam diagram, after the stitch knock-over level of the secondary feed II is reached. As a result, the control butt 51 is caused to be lifted to move within the path *a′*. On the other hand, as previously explained, the retracted intermediate jacks 5 which are operative in the secondary feed system II are not rocked outwardly at their upper end, they are not caused to enter into the recess 130 nor to be engaged by the sharp cam edge 131.

Due to the lifting of the intermediate jacks 5, by the sharp edge 131, the butts 61 of their associated needle jacks are caused to engage with the upper or rising surface of the lifting cam 29 and are thus moved into the path *c′*. The needles associated with these selectors are thus lifted into the knitting position and perform knitting operation in the main feed system I, where yarn is fed to them, and wherein they are lowered for engagement of the upper butts 61 of the needle jack on the left clearing cam 7, so that loops can be formed at this feed system.

When the intermediate jacks 5, which are not selected are cleared by the downwardly inclined edge 133 of the box ring 13, the upper ends of these jacks find themselves in the recess 132, at the end of the sharp cam edge 131. In this position, the intermediate jacks are retracted or lowered out of contact with the needle jacks 6 and, by action of the edge 133 which evolves with a radially extending contour surface (FIG. 2*b*) acting on the upper half edge of the intermediate jack 5. The upper end of the intermediate jack is pressed back into grooves 3 so that it assumes the original position as seen in FIG. 1*a*, whereby the process may be repeated over again.

The radially displaceable cams 22, 23, 24, 25 and 26 are selectively moved inwardly and outward to guide the lower and upper butts 62 and 61 through the movement of the main and subsidiary feeds, respectively.

It will be seen from the foregoing that with the use of a single patterning drum, selectively acting on given ones of the selectors in the needle cylinder that the needles can be separated for operation into either the main or secondary feed system. As a result, the apparatus needed for control of the knitting machine, can be greatly simplified.

A further variation of this system by which the needles can be separated into operation in the main feed as well as in a subsidiary or secondary feed, can be accomplished by eliminating the intermediate jacks shown in FIGS. 1–2 and replacing them with selector jacks 4 of sufficient length and positioned so within the needle grooves that they are displaceable directly into engagement with the needle jacks.

Figure 3:
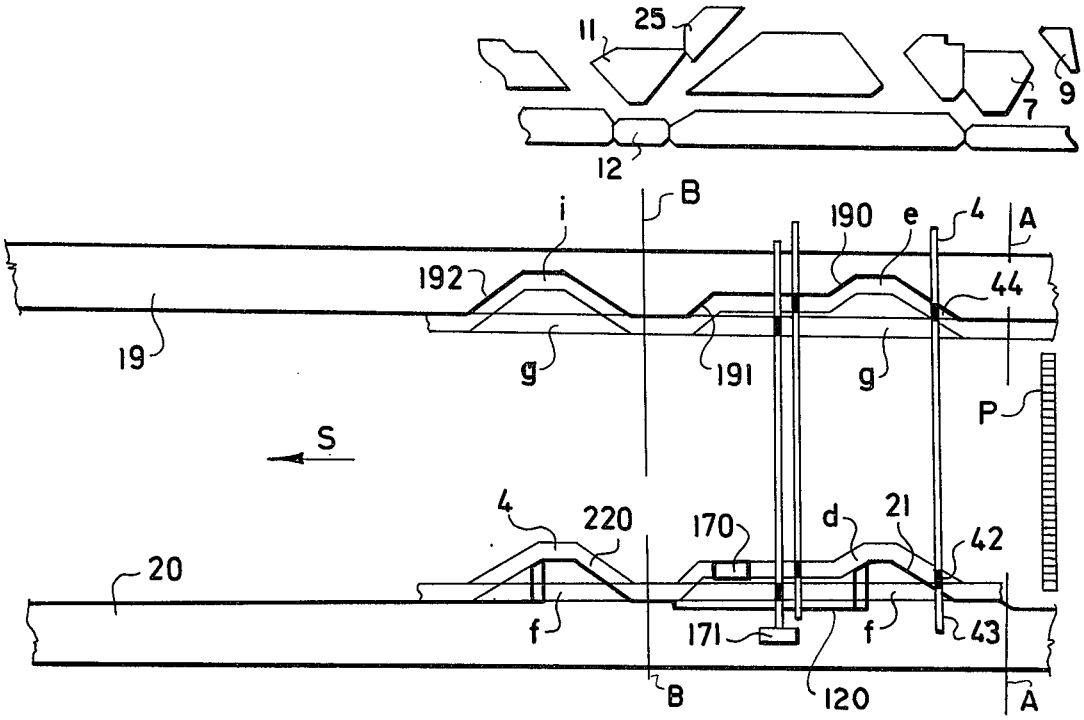
FIG. 3 is a diagram of a cam system, in planar development, showing an embodiment of the cam means for controlling the selector jacks.
Figure 4:
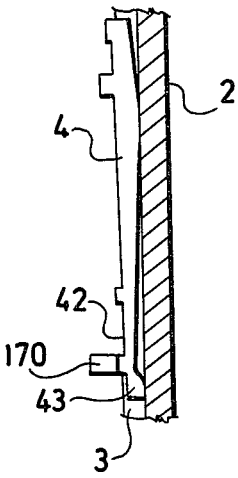
FIG. 4 is a diagram showing the selector jacks at a high position, at the moment of pressing into the needle grove.

As seen in FIG. 3, the box cam rings 19–20 are modified from those represented in FIG. 4 so that the edge 190 on the ring 19 is shorter in length and is continued to a horizontal edge which is in turn continued with a further edge 191. On the lower ring 20 there is formed a second lifting edge 220, substantially after the first lifting edge 21. Opposite to the second lifting edge 220, a corresponding recess with an edge 192 is provided on the upper cam ring 19. In addition, the means for rocking the selector jack 4 comprises a tilting cam 170 located above the edge of the lower cam ring 20, and downstream from the lifting edge 21 and a second tilting cam 171 located below the edge 120 intermediate the lifting edge 21 and the first tilting cam 170. The tilting cam 170 is adapted to act on the butt 42 while the second tilting cam 171 is adapted to act upon the inner surface of the extreme lower edge 43 of the selector jack 4 and is therefore mounted adjacent the cylinder 2, but not attached thereto.

The cams, or cam box rings respectively, used to control the movement of the needle jacks 6, are similar to that shown in FIG. 1, and the intermediate jacks 5 and its cam rings 13 and 14 are eliminated. The selector jacks 4 lie axially adjacent the needle jacks 6. The knock-over level point for the main feed being situated at the point denoted by the vertical line A-A while the knock-over level or for the subsidiary feed is situated at the point denoted by the vertical line B—B.

Similarly, in the manner described earlier, the selection of the selectors in the embodiment as shown in FIG. 3 is performed by means of a patterning drum in the following manner: The selector jack 4, rocked into the position shown in FIG. 5 by the patterning drum, so that its lower end 43 extends radially outward from the groove 3, approaches the set of pressbuttons P and is, according to the recorded program, either pressed back into the grooves 3, or retained in the extended position. In this manner the selector jacks 4 are again distributed into selected and non-selected positions, as specified in connection with the embodiment of FIG. 1. The chosen, or "selected" selector jacks 4 are thus caused to have their butts 42 engage the lifting edge 21 of the cam box ring 20 moving upward into the path e resulting in the lifting of the appurtenant needle jacks so that the needle jacks are lifted by their associated cams to have yarn fed to them in the subsidiary yarn feed system, as discussed above. The guiding butts 42 pass through the path d while the upper butts 44 pass through the path e, as indicated in FIG. 3. Upon lifting the appertenant needle jacks, the chosen selectors are caused to be retracted by engagement of their upper butts 44 on the edge 190 on the upper box ring 19, in a partial manner thereafter moving further horizontally. During this horizontal movement, the guiding butts 44, moving in path d are caused to engage against the tilting cam 170 so as to be pressed into the grooves 3, as indicated in FIG. 4. Thus, being retracted into the "non-selected" position, after moving the needle. Thereupon, the selector jack is retracted into the lowermost position by engagement with the second clearing edge 191 so that it reaches its lowermost "non-selected" position prior to the clearing point B—B for the needles of the subsidiary yarn feed system. Upon further rotation, the butts 42 and 44 of the selector jacks 4 pass horizontally through paths *f* and *g* in front of the second lifting edge 220. As a result, this selector jack 4, passes through the main feed in the lower or "non-selected" position, and being operative only in the secondary feed system.

The "non-selected" selector jacks 4, not operating in the secondary feed system, pass beyond the set of pushbuttons P through the horizontal paths f and g, without engagement to the lifting edge 21. The appurtenant needle jacks and needles are thus not lifted and do not perform in the subsidiary yarn feed system. Just before the knock-over level or clearing point of the subsidiary feed system, or in front of the position wherein the previously chosen selector jacks 4 are retracted, the lower ends 43 of the "non-selected" selector jacks 4 engage the tiling cam 171, adjacent to the needle cylinder 2, and are thus forced to be rocked outwardly of the grooves 3.

Thus, even before the "non-selected" selector jacks 4 arrive at the knock-over level B of the subsidiary yarn feed system, the selector jacks 4 are divided again into rocked and non-rocked position. The selector jacks 4, rocked by the tilting cam 171, have their lower guiding butts 42 pushed into contact with the second lifting edge 220. As a result, they are caused to be raised into the path i and thus engage the appurtenant needle jacks, and raised needles into knitting position which thus perform their knitting operation in the main feed. The lower guiding butts 42 of these "non-selected" selector jacks 4, after lifting the appurtenant needle, come into contact with the clearing edge 192 being thereafter lowered into the paths g and f respectively. Thus returning all of the needles, jacks, i.e. both selected and non-selected rocks to the initial position before selection by the combination of the patterning drum and set of pushbuttons P. The "selection" is repeated as the needle cylinder rotates.

It will be seen that even from this second embodiment, is depicted in FIGS. 3–5, the knitting machine can be caused to be selected for operation in the main and subsidiary feeds by operation of a single patterning drum electromagnetic means acting on a single set of cylinders. This greatly reduces the complexity of the macines, and simplifies their operation.

Various modifications and changes have been suggested in the foregoing description. Others will be obvious to those skilled in this art. Consequently, it is intended that the present disclosure be illustrative only and not limiting of the scope of the invention.

What is claimed:

1. The method of controlling the operation of the needles in a circular knitting machine having two yarn feed systems, a cam system and a needle selection system for each needle including at least a needle jack, a selector jack and an intermediate jack located therebetween, cooperating with said cam system to reciprocate the associated needle, comprising the steps of arranging before the stitch knock-over point of one of said feed systems, pattern selection means for rocking certain ones of said selector jacks into engagement with said cam system and a lifting cam arranged after the knock-over point of said one feed system to raise said certain ones of said selector jacks into engagement with said intermediate jack, to engage the needle jack to actuate the associated needles in the other of the feed systems, and arranging prior to the stitch knock-over point of the other of the feed systems a tilting cam to rock the intermediate jacks associated with the selector jacks not rocked by the patterning means into engagement with the cam system and after the stitch knock-over point of the other feed system a lifting cam to raise said rocked intermediate jacks to activate the associated needles in said one feed system.

2. Apparatus for controlling the operation of the needles in a circular knitting machine having two yarn feed systems, a cam system and a needle selection system for each needle including at least a needle jack, a selector jack and an intermediate jack located therebetween, cooperating with said cam system to reciprocate the associated needle, comprising pattern means arranged before the stitch knock-over point of one of said feed systems for rocking certain ones of said selector jacks into engagement with said cam system, a lifting cam arranged after the stitch knock-over point of said one feed system to raise said certain ones of said selector jacks into engagement with said intermediate jacks, to engage the needle jacks to actuate with associated needles in the other of the feed systems, a tilting cam arranged prior to the stitch knock-over point of the other of the feed systems to rock the intermediate jacks associated with the selector jacks not rocked by the patterning means into engagement with the cam system and a lifting cam arranged after the stitch knock-over point of the other feed system to raise said rocked intermediate jacks to activate the associated needles in said one feed system.

* * * * *